US009169111B2

(12) United States Patent
Cummings

(10) Patent No.: US 9,169,111 B2
(45) Date of Patent: Oct. 27, 2015

(54) SAFETY DEVICE FOR AN AERIAL LIFT

(71) Applicant: Bluesky Solutions Limited, Leicestershire (GB)

(72) Inventor: Paul Cummings, Bicester (GB)

(73) Assignee: Blue Sky Access Ltd., Marlow, Buckinghamshire (GB)

( * ) Notice: Subject to any disclaimer, the term of this patent is extended or adjusted under 35 U.S.C. 154(b) by 0 days.

(21) Appl. No.: 14/459,842

(22) Filed: Aug. 14, 2014

(65) Prior Publication Data

US 2014/0353082 A1 Dec. 4, 2014

Related U.S. Application Data

(63) Continuation of application No. 12/806,101, filed on Aug. 5, 2010, now abandoned.

(30) Foreign Application Priority Data

Aug. 6, 2009 (GB) ..... 0913692.0

(51) Int. Cl.
*B66F 11/04* (2006.01)
*B66F 17/00* (2006.01)
*B66F 9/24* (2006.01)

(52) U.S. Cl.
CPC ..... *B66F 11/046* (2013.01); *B66F 9/24* (2013.01); *B66F 11/044* (2013.01); *B66F 17/00* (2013.01); *B66F 17/006* (2013.01)

(58) Field of Classification Search
CPC ..... B66F 11/046
USPC ..... 182/18
See application file for complete search history.

(56) References Cited

U.S. PATENT DOCUMENTS

| | | | |
|---|---|---|---|
| 2,787,278 | A | 4/1957 | Mitchell |
| 3,696,372 | A | 10/1972 | Garrett et al. |
| 4,456,093 | A | 6/1984 | Finley et al. |
| 4,979,588 | A | 12/1990 | Pike et al. |
| 6,405,114 | B1 | 6/2002 | Priestley et al. |
| 2003/0174064 | A1 | 9/2003 | Igarashi et al. |

(Continued)

FOREIGN PATENT DOCUMENTS

| | | | |
|---|---|---|---|
| GB | 2 450 360 | A | 12/2008 |
| GB | 2450360 | A * | 12/2008 |

(Continued)

OTHER PUBLICATIONS

Communication received on EP Application 10251395.9, dated Mar. 14, 2013.

(Continued)

*Primary Examiner* — Alvin Chin-Shue
(74) *Attorney, Agent, or Firm* — Foley & Lardner LLP

(57) ABSTRACT

An aerial lift having a basket or cage having a control panel for an operator standing in the basket to maneuver the basket to a desired location, a safety switch means operable to prevent further movement of the basket in unsafe conditions, and a safety device comprising a load cell or strain gauge on the cage and an auxiliary safety switch operatively connected to the load cell via an amplifier is connected in series with the safety switch means, the auxiliary switch being operable to cut off power to the safety switch means when the sensed load on the cage exceeds a predetermined value, typically if the load strikes a stationary object.

11 Claims, 6 Drawing Sheets

(56) References Cited

U.S. PATENT DOCUMENTS

| | | | |
|---|---|---|---|
| 2004/0262078 | A1 | 12/2004 | Bailey |
| 2012/0305332 | A1 | 12/2012 | Cummings |

FOREIGN PATENT DOCUMENTS

| | | | |
|---|---|---|---|
| GB | 2 457 908 | A | 9/2009 |
| GB | 2 463 915 | A | 3/2010 |
| JP | 11-100199 | | 4/1999 |
| JP | 2001-099107 | | 4/2001 |
| WO | WO-2009/037429 | A1 | 3/2009 |

OTHER PUBLICATIONS

European Search Report for European Patent Application No. EP 10251395, issued Jun. 29, 2012, 6 pages.

United Kingdom Search Report for UK Application No. 1013179.5, Search Completed Nov. 26, 2010.

* cited by examiner

SAFETY DEVICE FOR AN AERIAL LIFT

CROSS-REFERENCE TO RELATED APPLICATIONS

This application is a continuation of U.S. patent application Ser. No. 11/806,101, entitled "SAFETY DEVICE FOR AN AERIAL LIFT", filed on Dec. 20, 2012, which claims priority to United Kingdom Application No. 0913692, entitled "A SAFETY DEVICE FOR AN AERIAL LIFT", filed on Aug. 6, 2009. Both of the aforementioned applications are incorporated by reference in their entireties and for all purposes.

TECHNICAL FIELD

This invention relates to a safety device for use within a cage or basket of the type mounted on the end of an extendable boom and particularly for use with a material rack.

BACKGROUND

Building construction sites for large buildings frequently employ aerial lift equipment for lifting operatives to elevated locations for, for example, the installation of overhead pipe work during the construction of a building.

A typical aerial lift may comprise a mobile self drive vehicle having an extendable boom which has an elevator basket or cage for housing operatives secured to the end of the boom. The basket may contains a control panel which permits a user standing the basket or cage to maneuver the cage to a raised location which facilitates the carrying out of work. The boom is typically raised by a powered hydraulic system on the vehicle.

It is known for the operators of such lifts to mount lengths of materials to the cages, by for example tying or lashing materials to the structure of the cage. This may give rise to dangerous situations, for example, if the length of material were to hit a stationary object such as a pillar or beam during maneuvering of the cage. Another danger could be caused by pipes or other material lengths slipping their lashings and dropping from the elevated cages.

The present invention provides a safety device and a material rack for use in an elevator cage so that the need for bad practice is reduced, increasing safety helping prevent death or serious injury in the event of the cage or materials supported on the cage hitting an abutment or other stationary object, for example a building pillar or support girder.

SUMMARY

One embodiment of the invention relates to According to a first aspect of the present invention, there is provided a safety device for an aerial lift having a basket or cage with controls, typically a control panel, which permit an operator standing in the basket to maneuver the basket to a desired location, the controls for the aerial lift additionally including safety switch means operable to prevent further movement of the basket if conditions become unsafe, the safety device comprising a load cell or strain gauge fixed to the cage and an auxiliary safety switch operatively connected to the load cell and connected in series with the safety switch means, the auxiliary switch being operable to cut off power to the safety switch means when the sensed load exceeds a predetermined value.

The hitting of a stationary object external to the cage the cage is sensed as an increase in load detected by the load cell(s).

The safety switch means typically provides a closed switch signal to the controls before the controls become operable and the load cell is connected via an amplifier to a solenoid operable auxiliary switch means which is operable to cut off said closed switch signal.

The auxiliary switch may also be utilized to operate an alarm which preferably comprises a beacon and/or an audible warning device. The alarm may further include an RF transmitter which sends a radio signal to at least one further alarm remote from the basket and which includes a co-operating receiver which operates said further alarms.

A second aspect of the present invention provides an aerial lift having a basket or cage having an operator control panel which permits an operator standing in the basket to maneuver the basket to a desired location, the controls including a safety switch means which needs to be closed before controls on the operator panel become operable, and a safety device according to the first aspect of the present invention.

The safety switch means may include one or all of a manually operable emergency stop switch, a foot operable safety switch which provides a switch-closed signal to the controls before said controls are operable, and an overload stop switch which cuts power to the basket when a load lifted exceeds a predetermined limit.

Preferably, the auxiliary switch is located in the power feed to at least one of the footswitch, the emergency stop switch and the overload stop switch or in the electrical signal line between the footswitch and the controls.

The aerial lift may comprise a self drive mobile lift of any suitable type having an extendable boom with the cage mounted at one end of the extendable boom, which is typically raised by a powered hydraulic system on the vehicle. The cage typically has a safety barrier including a kick plate adjacent the floor, and the rack may be secured to the kick plate.

The alarm may be mounted to the underside of the basket.

The cage has a floor surrounded by the safety barrier, and may further includes a material storage rack secured within the safety barrier and standing on said floor, the rack in use supporting lengths of material which may extend without the cage, wherein the load cell or strain gauge is fixed to the rack.

A plurality of aligned cradles which in use support lengths of material may be mounted on the rack, and at least one load cell is operatively located between a selected cradle and the rack. Preferably each cradle has a downwardly extending tubular leg which is on a spigot fixed to the rack and the load cell(s) is/are preferably located to sense loads acting between said leg and the spigot.

The rack may be formed from two separate substantially U-shaped support frames which fit within the safety barrier at opposite ends of the cage are self supporting within the cage, each support frame in use standing on said floor and being secured to the safety barrier, and having at least one cradle thereon. Each support frame may have an adjustable length bridge portion, preferably using mutually telescopic parts, allowing the frames to be used on different width elevator cages.

The U-shaped frames are each formed so that the arms and the bridge portion lie adjacent the safety barrier. Each cradle may be mounted across the bridge and one of said arms.

Further cradle(s) on each support frame are provided on a leg extending downwardly from said one arm. The cradle(s) on said leg are rotatably mounted around the vertical axis of the leg permitting the cradles to be moved from inwardly facing positions to outward facing positions. That is inwardly and outwardly with respect to the cage.

BRIEF DESCRIPTION OF THE FIGURES

The invention will be described by way of example and with reference to the accompanying drawings in which.

DETAILED DESCRIPTION

Figure 1:
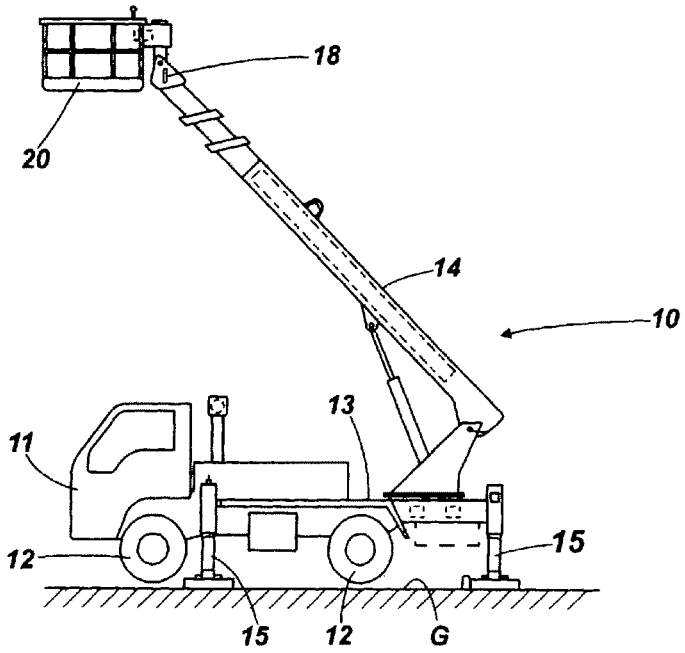
FIG. 1 is a view of a vehicle having an aerial lift according to the present invention mounted on an extendible boom.

With reference to FIG. 1 of the drawings, there is shown a vehicle 10 in the form of a self drive mobile lift of any suitable type. The vehicle 10 has a drivable vehicle body 11 having wheels 12 and an extendable boom 14 mounted on a load carrying platform 13 at the rear of the vehicle. Stabilizers 15 are provided for steadying the vehicle on the ground G. A basket or cage 20 is mounted on the free end of the boom 14 and the basket, in use, can be raised or lowered and generally maneuvered relative to the ground as is well known. The basket 20 is shown in a raised condition. The boom 14 is raised, lowered, extended, rotated etc. by any suitable means, typically operated by a powered hydraulic system provided on the vehicle 10. The boom 14 may be provided with a load sensor 18 which senses the total load on the boom.

The aerial lift 10 is shown by example only and any type of aerial lift may be used and the present invention is applicable to any form of aerial lift having an operator carrying basket, cage or platform which is provided with controls in the basket that allow the operator to maneuver the basket and vehicle utilizing the vehicle's power systems.

Figure 2:
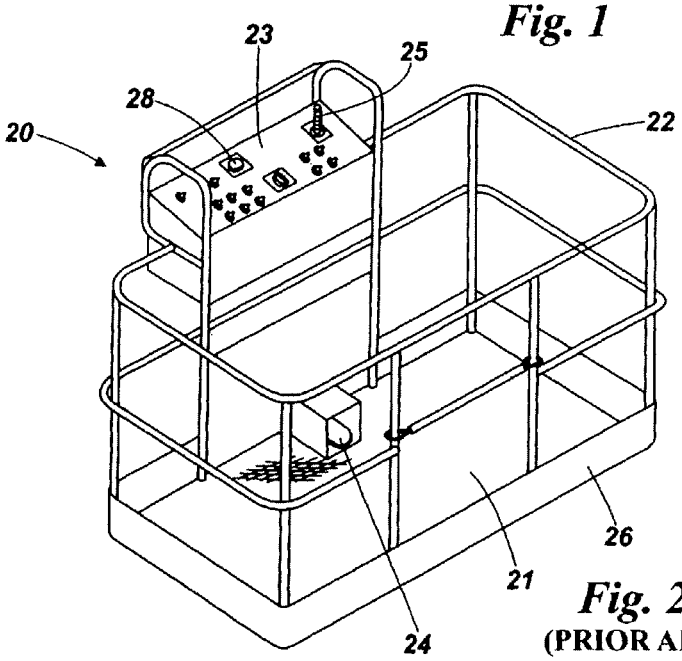
Fig. 2 (PRIOR ART)
FIG. 2 is an isometric view a typical prior art basket or cage mounted on the extendible boom shown in FIG. 1.
Figure 3:
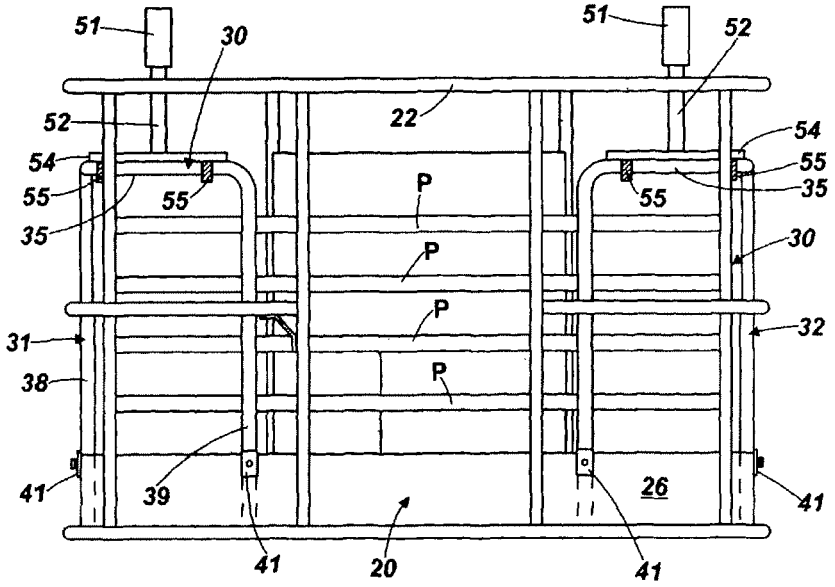
FIG. 3 is a front view of an elevator cage including a material handling rack according to the present invention.
Figure 4:
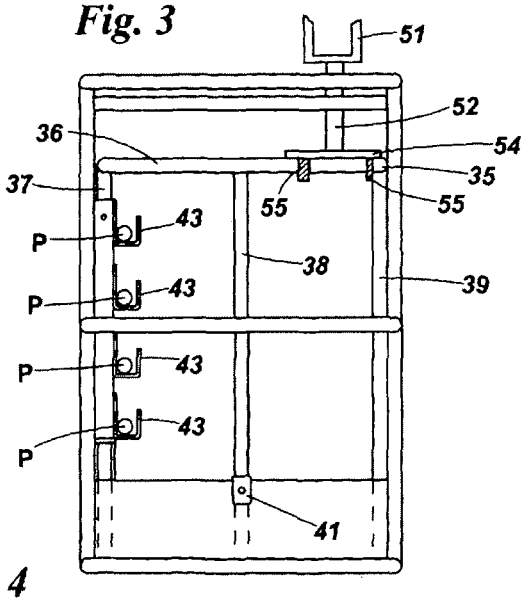
FIG. 4 is a side view of the cage and rack shown in FIG. 3.
Figure 5:
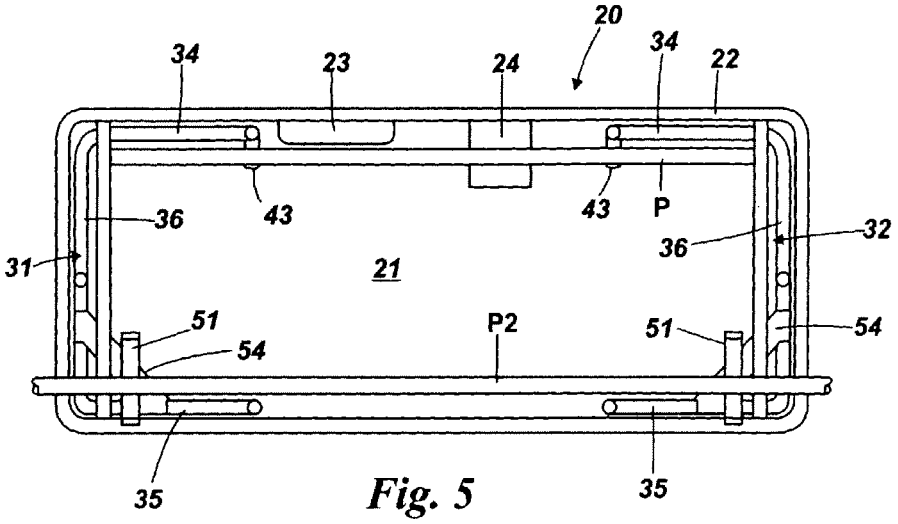
FIG. 5 is a plan view of the cage and rack shown in FIG. 3.
Figure 6:
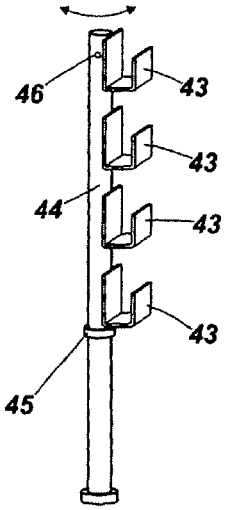
FIG. 6 is an isometric view of a support leg and cradles.
Figure 7:
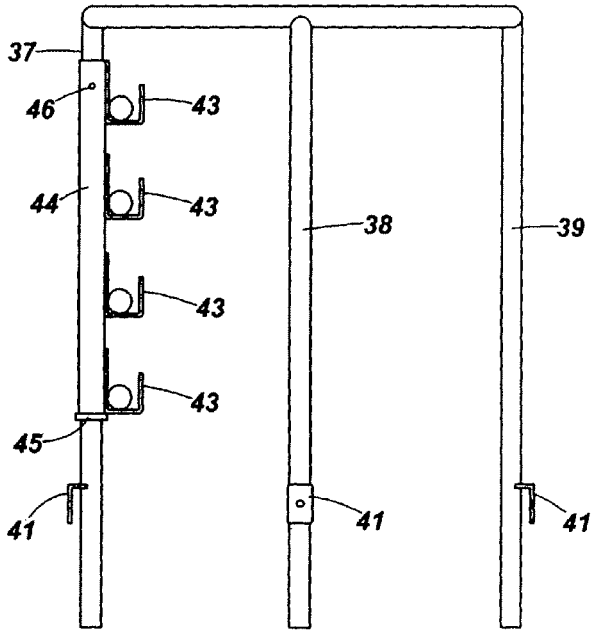
FIG. 7 is a side view of a one support frame forming part of the rack.

With reference to FIG. 2, there is shown the lift or elevator cage or basket 20 having a floor 21 surrounded by a safety barrier 22. The safety barrier 22 may include a kick-plate 26 located adjacent the floor 21. The cage 20 is provided with a control 23, typically in the form of a control panel, whereby an operator standing in the cage 20 can cause the cage to be moved to a desired location. The control 23 includes a foot operated safety switch 24 which must be depressed before an operator in the cage can cause the lift 10 to move the basket. In the event that the foot safety switch 24 is raised any movement of the cage will cease immediately. The foot switch 24 is typically connected to a control means, usually a valve, see FIG. 8, which shuts off the vehicle's power supply to prevent movement of the cage in the absence of a switch-closed signal from the foot switch 24. An emergency stop 28 may also be provided on the control panel 23 and is connected to valve V. The general movement of the cage is controlled by a control lever 25.

With reference now to FIGS. 3 to 7, there is shown the elevator cage 20 including a material rack 30 for the storage of lengths of pipe. The length of pipe may include short lengths P supported within the cage and long lengths P2 which extend without the cage. The rack 30 is fitted within the elevator cage 20 and is surrounded by the safety barrier 22.

The floor 21 of the cage 20 is substantially rectangular in shape with the safety barrier 22 extending around all four sides of the cage 20. For this example, the front of the cage is designated as being away from the boom 14 and the rear of the cage is designated as adjacent the boom 14. The rack 30 comprises two substantially U-shaped support frames 31,32 fitting within the safety barrier 22 at opposite ends of the cage 20. The U-shaped support frames 31,32 are self supporting within the cage 20 and each comprises two arms 34,35 interconnected by a bridge portion 36, the two support frames 31,32 being substantially mirror images one of the other. The two arms 31,32 and bridge portion 36 having vertical legs 37,39, & 38 respectively, extending downwardly to rest on the cage floor 21.

The U-shaped frames 31,32 are each formed so that the arms 34, 35 and the bridge portion 36 lie adjacent side portions of the safety barrier 22. The one arm 34 is adjacent the rear portion of the barrier and the bridge portion is adjacent a respective side portion of the barrier. The other arm 35 is adjacent the front portion of the barrier 22.

The two support 31,32 each stand on the floor 21 of the cage and their respective legs 37,38,39 are secured to the kick plate 26 by means of clamps 41 located at the lower end portions of the legs.

Figure 8:
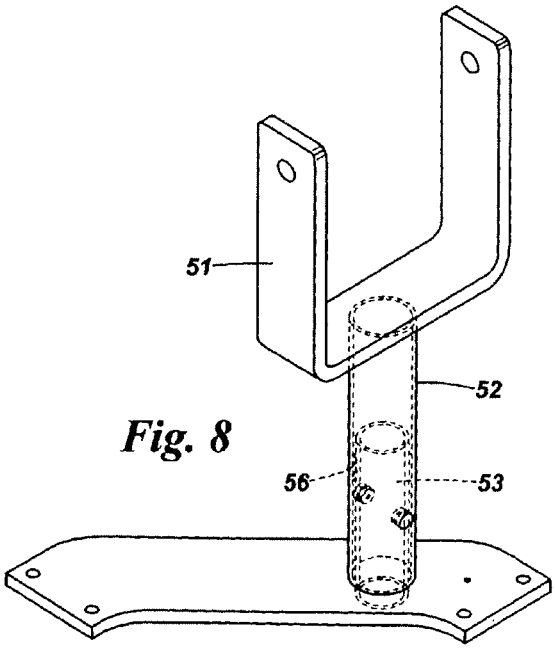
FIG. 8 is a isometric view of cradle for supporting a length of pipe that extend without the cage.

The front arm 35 and bridge 36 of each support frame 31,32 provide a support for pipe support cradle 51. A cradle is best seen in FIG. 8 and comprises a downwardly extending tubular leg 52 which engages a spigot 53. The spigot 53 is vertically mounted on a base plate 54 which in turn is fixed across the bridge 36 and front arm 35, preferably by brackets 55. The two cradles 51 can support lengths of pipe P2 that extend beyond the cage 20.

The leg 37 adjacent the rear portion of the barrier 22 has a tubular sleeve 44 thereon with at least one further cradle 43, and preferably a plurality of further cradles 43, fixed to the sleeve 44. The tubular sleeve 44 is rotatably mounted on the leg 37 and is supported at its lower end by an abutment 45 on the leg and has apertures 46 at its upper end for a fixing pin.

The two frames 31,32 when standing on the floor 21 of the cage 20 form the material rack 30 in which the further cradles 43 on the two frames are in alignment for storage of short lengths of pipe material P extending within the cage between the two frames. The further cradle(s) 43 on the legs 37 are rotatable around the vertical axis of each leg 37 permitting the cradles 43 to move from inwardly facing positions as shown, to outward facing positions. Inwardly and outwardly are defined with respect to the cage. The cradles 43 may be secured in position by pin clips (not shown) passing through the apertures 46 and co-operating apertures (not shown) in the leg 37.

An auxiliary safety device comprises at least one strain gauge or a load cell 56 fixed to a suitable portion of the material rack. Preferably the load cell is located within the tubular vertical leg 52 of a cradle 51 for the longer lengths of material loaded on the cage 20. The load cell 56 is operatively connected between the tubular leg 52 and the spigot 53 to measure loads transmitted to spigot and hence cage 20 and can be used to detect changes in load in particular, should the pipe P accidentally abut a fixed object. The cradle 51 spigot and tubular leg may be provided with apertures for locking pins (not shown).

Figure 9:
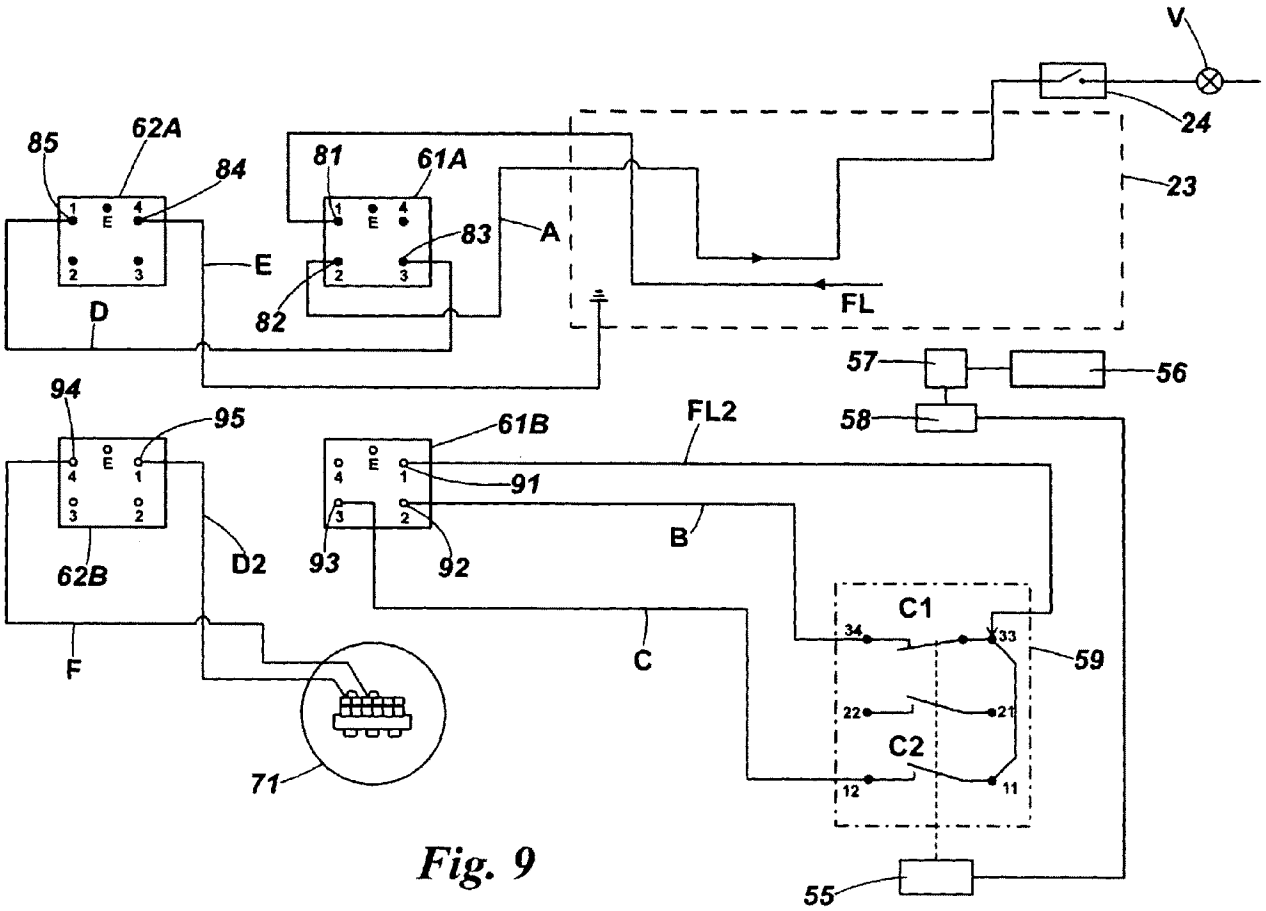
FIG. 9 is a circuit diagram for a first embodiment of the invention incorporating the safety device and auxiliary safety switch into the control electrical circuit.

Referring now to FIG. 9, the load cell 56 is a transducer which is connected to a signal filter 57 which removes signals below a predetermined value. Signals which pass through the filter 57 are preferably passed to an amplifier 58. The amplified signal is then passed to a switch 59 operated by a solenoid 55. The solenoid switch 59 has a first set of contacts C1 which are operable to cut-off the power supply FL to the foot switch 24. The contacts C1 (see FIG. 8) are closed when no signal is passed to the solenoid 55 allowing normal operation of the control 23.

When the solenoid 55 receives a signal from the load cell 56 the switch contacts C1 are opened cutting the power supply to the foot switch 24. This is shown in FIG. 9.

The solenoid switch 59 may also include a second contact set C2 (see FIG. 9) which are connected via connectors 61 & 62 to an emergency alarm 71 which is mounted on the basket 20 in a visible location, preferably on the underside of the floor 21. The alarm 71 may include an RF transmitter which send a radio signal to at least one further alarm (not shown) remote from the basket 20 and which includes a co-operating receiver which operates the second alarm.

The power feed line FL to the foot safety switch 24 is diverted to a socket 81 within the socket part 61A of a connector 61. A cooperating pin 91 of the plug part 61B of connector 61 is connected via electrical cable FL2 to contacts C1 and C2 in parallel. The other sides of contacts C1 and C2 are connected via electrical cable B and C to separate pins 92,93, respectively on the plug part 61B. The pins 92,33 are connectable with cooperating sockets 82 and 83 on the socket part 61A. The socket 82 is connected via electrical wire A and connection block 34 to the foot switch 24. The other socket 83 is connected by electrical cable D to a socket 85 of the socket part 62A of connector 62. A second socket 84 of the socket part 62A is connected to Earth or ground. The socket 85 is connectable with a co-operating pin 95 on the plug part 62B of connector 62. The pin 95 is connected by cable D2 to the alarm 71. The alarm 71 is grounded via cable F connected to pin 94 on the plug part 62B. The pin 94 co-operates with socket 84 for grounding the alarm 71.

As shown in FIG. 9, the solenoid switch 59 is set with contacts C1 closed and contacts C2 open. In this condition, the power feed line FL is connected through connector 61 and contacts C1 to the safety foot switch 24. The contact C2 is open cutting off power to the alarm 33.

Figure 10:
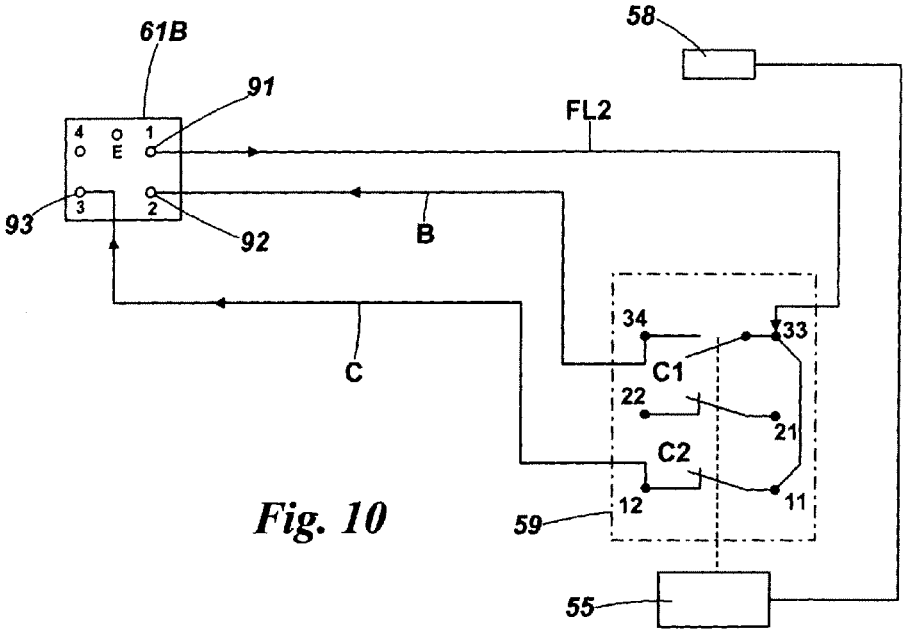
FIG. 10 shows the auxiliary switch contacts in the activated condition.

With reference to FIG. 10, when the solenoid switch 59 is activated, the contacts C1 and C2 within the switch 59 are caused to move so that C1 becomes open and C2 closes. In this state, the power feed line FL2 is disconnected from the pin 92 of the connector 61 and the power feed line FL2 is connected to the pin 93 of the connector 61. In this state power is supplied to the alarm 71 and disconnected from the foot switch 24 thus immediately immobilizing the basket 20. The circuitry in FIG. 8 could alternatively be adapted for insertion into the signal line from the switch 24 to the control means V.

Figure 11:
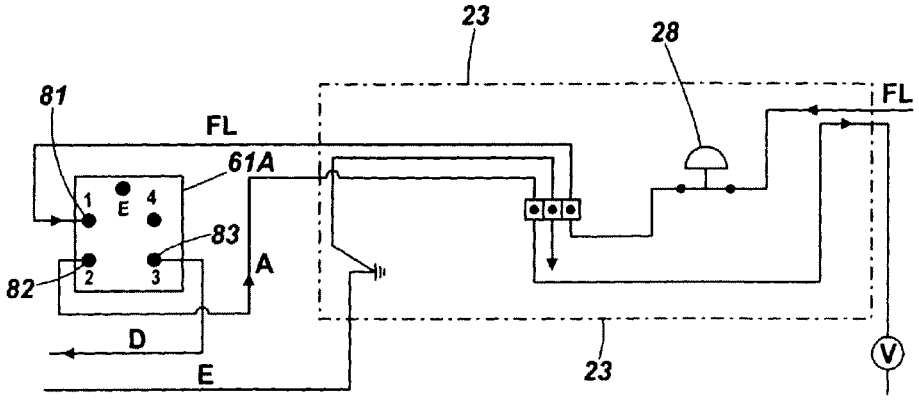
FIG. 11 shows in a portion of the circuit in FIG. 9, a second embodiment of the invention showing the connection of the safety device in combination with the emergency stop.

With reference to FIG. 11, there is shown the electrical circuit for a second embodiment of the safety device. The power feed line FL to the emergency stop switch 28 is diverted downstream thereof to the socket 81 within the socket part 61A of connector 61. A cooperating pin 91 of the plug part 61B of connector 61 is connected to the auxiliary switch 59 as previously described. The other socket 83 is connected by electrical cable D to a socket 85 of the socket part 62A of connector 62 also as described above. The socket 82 is connected via electrical wire A to the valve means V. Operation of the emergency stop switch 28 cuts off power to the valve.

When an overload on the storage rack 30 is detected by load sensor 56 causing the solenoid operated auxiliary switch 59 to be activated the contacts C1 open cutting off power to the emergency stop switch 30 and causing the alarm 71 to operate as previously described.

Figure 12:
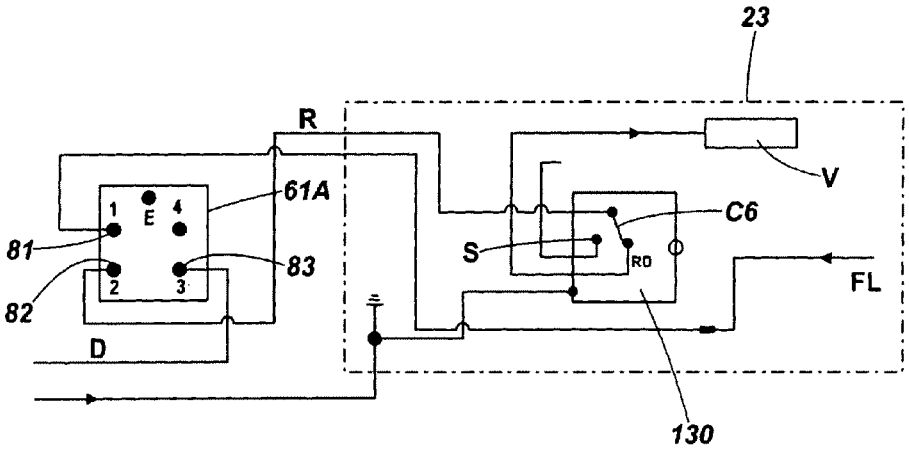
FIG. 12 shows in a portion of the circuit in FIG. 9, a third embodiment of the invention with the safety device in combination with the boom overload.

With reference to FIG. 12, there is shown the electrical circuit for a third embodiment of the safety device. The power feed line FL to an overload sensor stop switch 130 is diverted upstream thereof to the socket 81 within the socket part 61A of connector 11. A cooperating pin 91 of the plug part 61B of connector 31 is to the auxiliary switch 26 as previously described. The other socket 83 is connected by electrical cable D to a socket 85 of the socket part 62A of connector 32 also as described above. The socket 82 is connected via electrical wire R to the overload stop switch 130. The output 1311 from the overload stop switch is connected to valve means V. The overload stop switch 130 has contacts C6 operated by a solenoid S to cut off power to the valve means V when an overload on the boom is sensed. The operation of the auxiliary safety switch 26 to open contacts C1 cuts off power via wire R to the overload stop switch 130 and to the valve means V.

What is claimed is:

1. An aerial lift comprising:

a basket or cage with controls which permit an operator standing in the basket or cage to maneuver the basket or cage to a desired location;

a safety switch which needs to be closed before the controls become operable; and a safety device including a load cell or strain gauge and an auxiliary safety switch operatively connected to the load cell or strain gauge and connected in series with the safety switch, the auxiliary safety switch being operable to cut off power to the safety switch when a load value is sensed that exceeds a predetermined load value indicating a hitting event;

wherein the basket or cage has a floor surrounded by a safety barrier, and the load cell or strain gauge of the safety device is fixed to a material storage rack, for use in supporting lengths of material, secured within the safety barrier and standing on the floor of the basket or cage;

wherein a plurality of aligned cradles for use in supporting lengths of material are mounted on the material storage rack, and at least one load cell or strain gauge is operatively located between a respective cradle and the material storage rack;

wherein each cradle has a downwardly extending tubular leg which is mounted on a spigot mounted on the material storage rack, and each of said load cells or strain gauges is located to sense loads acting between said tubular leg and said spigot of the respective cradle.

2. The aerial lift of claim 1, wherein the safety switch comprises at least one of: a manually operable emergency stop switch, a foot operable safety switch, and an overload stop switch.

3. The aerial lift of claim 2, wherein the auxiliary safety switch is located in one of: a power feed to the foot operable safety switch, a power feed to the manually operable emergency stop switch, a power feed to the overload stop switch an electrical signal line between the foot operable safety switch and the controls, an electrical signal line between the manually operable emergency stop switch and the controls, the overload stop switch and the controls.

4. The aerial lift of claim 1, wherein the material storage rack comprises two substantially U-shaped supporting frames with at least one cradle thereon.

5. The aerial lift of claim 1, wherein the safety barrier includes a kick plate adjacent the floor, and the material storage rack is secured to the kick plate.

6. The aerial lift of claim 1, wherein the safety switch provides a closed switch signal to the controls before the controls become operable and the load cell or strain gauge is connected via an amplifier to a solenoid operable auxiliary safety switch which is operable to prevent said closed switch signal to the controls.

7. The aerial lift of claim 6, wherein the auxiliary safety switch is located in a power feed to the safety switch or in an electrical signal line between the safety switch and the controls.

8. The aerial lift of claim 1, wherein the auxiliary safety switch also operates an alarm when a load value is sensed that exceeds a predetermined load value indicating a hitting event.

9. The aerial lift of claim 8, wherein the alarm comprises at least one of: a beacon, an audible warning device.

10. The aerial lift of claim 8, wherein the alarm further comprises an RF transmitter for sending a radio signal to a further alarm remote from the basket or cage which comprises a cooperating receiver.

11. The aerial lift of claim 8, wherein the alarm is mounted to the underside of the basket or cage.

* * * * *